United States Patent [19]

Jackson et al.

[11] Patent Number: 4,827,901

[45] Date of Patent: May 9, 1989

[54] FILTER BASE FOR FORCED AIR FURNACE

[76] Inventors: Jerry D. Jackson, 6969 Lakewood Blvd., Dallas, Tex. 75214; Terry D. Youngblood, 10844 Waterbridge Cir., Dallas, Tex. 75218

[21] Appl. No.: 157,604

[22] Filed: Feb. 19, 1988

[51] Int. Cl.[4] ..... F24H 3/02

[52] U.S. Cl. ..... 126/110 R; 126/99 R; 126/112; 55/267

[58] Field of Search ..... 126/110 R, 110 A, 110 B, 126/99 R, 112, 114; 237/53, 48; 55/267, 493; 34/82, 90

[56] References Cited

U.S. PATENT DOCUMENTS

| | | | |
|---|---|---|---|
| 1,779,201 | 10/1930 | Wickstrom | 126/110 R |
| 2,263,732 | 11/1941 | Johnston | 55/267 |
| 2,622,585 | 12/1952 | Rifle | 126/110 R |
| 2,693,914 | 11/1954 | Payne | 126/110 R |
| 3,294,082 | 12/1966 | Norris | 126/110 R |
| 3,448,736 | 6/1969 | Schenberger | 126/110 R |
| 3,494,113 | 2/1970 | Kinney | 55/493 |
| 4,227,315 | 10/1980 | Hight | 34/82 |

*Primary Examiner*—James C. Yeung
*Attorney, Agent, or Firm*—Dennis T. Griggs

[57] ABSTRACT

A filter support base for use with an upflow forced air furnace is disclosed. A rectangular base defining a return air plenum is adapted for floor mounting support of the furnace and includes a pass-through opening in communication with the intake opening of the furnace plenum. A filter base provides a rectangular enclosure that is secured intervening between the base and the supported furnace. Within the filter box there are elongated channel members extending about the internal perimeter in planar alignment with a filter access opening for support of a received filter element in the return air stream. A cover, hinge supported above the opening, is displaceable for covering the opening during normal furnace operation and for exposing the opening when filter access is desired.

3 Claims, 2 Drawing Sheets

FILTER BASE FOR FORCED AIR FURNACE

FIELD OF THE INVENTION

This invention relates generally to heating, ventilating and air conditioning equipment, and in particular to equipment for supporting a filter in a forced air furnace or heat pump installation.

BACKGROUND OF THE INVENTION

Most forced air conditioning systems, furnaces and heat pump installations utilized for conditioning household or commercial space, known as HVAC systems, are prefabricated to include space for installing an air filter in the airstream on the suction side of the blower. The filters are sometimes of a standard size and are commercially available. They commonly are disposable and are intended to be used only for a limited time as trapped dust particles begin to accumulate. Alternatively, some filters are of a more permanent reusable type that are intended to be periodically cleaned and reused. Removal and replacement of the filter is usually performed in an accessible location in or about the HVAC blower housing or in the return air duct work leading to the blower.

Servicing of the HVAC filters according to a recommended schedule has been known to vary to a large extent with the habits of the individual providing the maintenance. However, by and large, filter servicing is conducted at a frequency considerably less than desirable. While the infrequency of filter servicing can be attributed to a variety of different factors, paramount has been the inconvenient and limited access to the filter. Either because of a relatively remote inaccessible location and/or difficulty in removing equipment panels and doors necessary to gain filter access, the associated problems tend to discourage the proper and timely servicing of the filters. Moreover, even in many situations in which service is timely provided, the filter support structure has failed to secure the filter. In such cases, the filter may fall into the flow passage or become seized off-center, causing bypass leakage.

It can be appreciated that the use of air filters is highly desirable as a matter of both health and cleanliness. Not only do they serve to remove dust particles that would otherwise be introduced to the conditioned space but they also maintain the heat exchanger and evaporator coil unit adequately clean of particles that if not removed could adversely affect the heat transfer efficiency. In any event, failure to replace a dirty air filter results in a reduced air flow from the blower and increased power consumption for operation of the HVAC system.

BACKGROUND OF THE PRIOR ART

The art of forced air conditioning equipment of largely prefabricated construction is utilized for domestic household and modest sized commercial installations has been well developed over the years. An appointed site and accompanying support structure is normally provided in and about the HVAC heat exchanger or connecting duct work to receive and retain an air filter in a manner providing for filter removal as a maintenance item. Exemplifying such HVAC constructions of the prior art are the disclosures of U.S. Pat. Nos. 1,847,609; 2,263,732; 3,494,113; 3,716,967; and 4,465,499.

OBJECTS OF THE INVENTION

It is therefore an object of the invention to provide an improved filter containment apparatus for supporting a filter in a forced air conditioning system.

Another object of the invention is to provide an improved filter assembly for placement in relative proximity to the upflow HVAC heat exchanger unit in a manner that provides convenient access to the filter for accommodating service by maintenance personnel, homeowners or tenants.

Yet another object of the invention to provide secure support for a HVAC air filter while reducing unfiltered bypass flow.

SUMMARY OF THE INVENTION

This invention relates to a filter containment apparatus for use in a forced air HVAC system. More specifically, the invention relates to an improved form of self-contained filter housing assembly that not only provides easy access for air filter replacement but also provides maximized and stable support of the filter within the airstream in a manner precluding the bypass flow of unfiltered air.

In a preferred embodiment, the filter housing assembly has a rectangular configuration sized to the HVAC unit and filter size to be utilized. The filter housing is secured between a floor mounted base and an air inlet opening leading to the return plenum chamber of an upflow HVAC heat exchanger unit supported on the base. Included within the filter housing are structural support members extending about the internal perimeter formed by three side walls in order to slideably receive and support filter therein.

An access opening is defined in one of the side walls selected with an orientation and location providing for convenient placement and retrieval of a filter to and from the internal support. A cover plate is hinge supported adjacent to the opening and is positioned flush against the wall surface surrounding the opening. A seal about the opening during forced air operation is achieved as the cover is drawn against the wall surface by the suction force of the forced inlet air.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
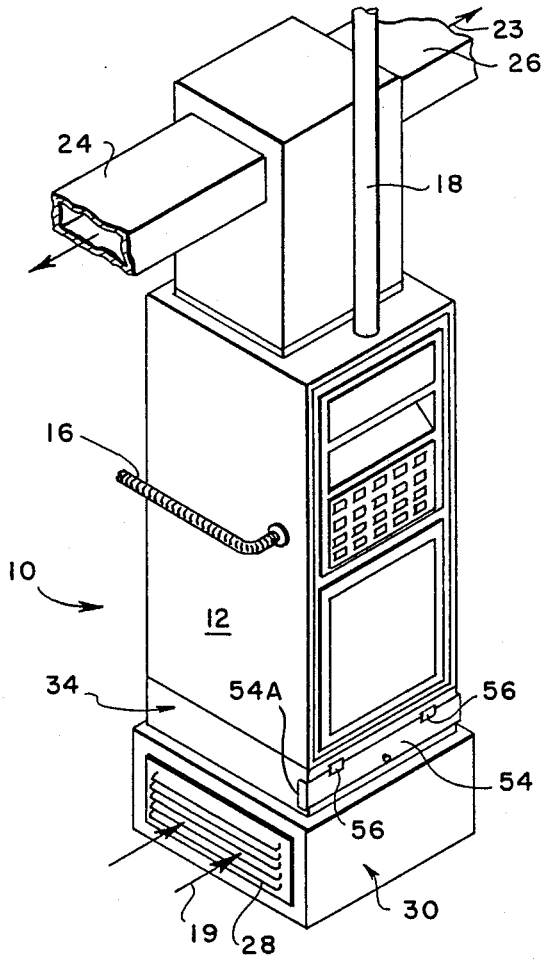
FIG. 1 is a perspective view of an upright furnace embodying the filter apparatus of the invention.

In the description which follows, like parts are marked throughout the specification and drawings with the same reference numerals, respectively. Drawing figures are not necessarily to scale and in certain views parts may be drawn rotated into the plane of the drawing for purposes of clarity.

Figure 2:
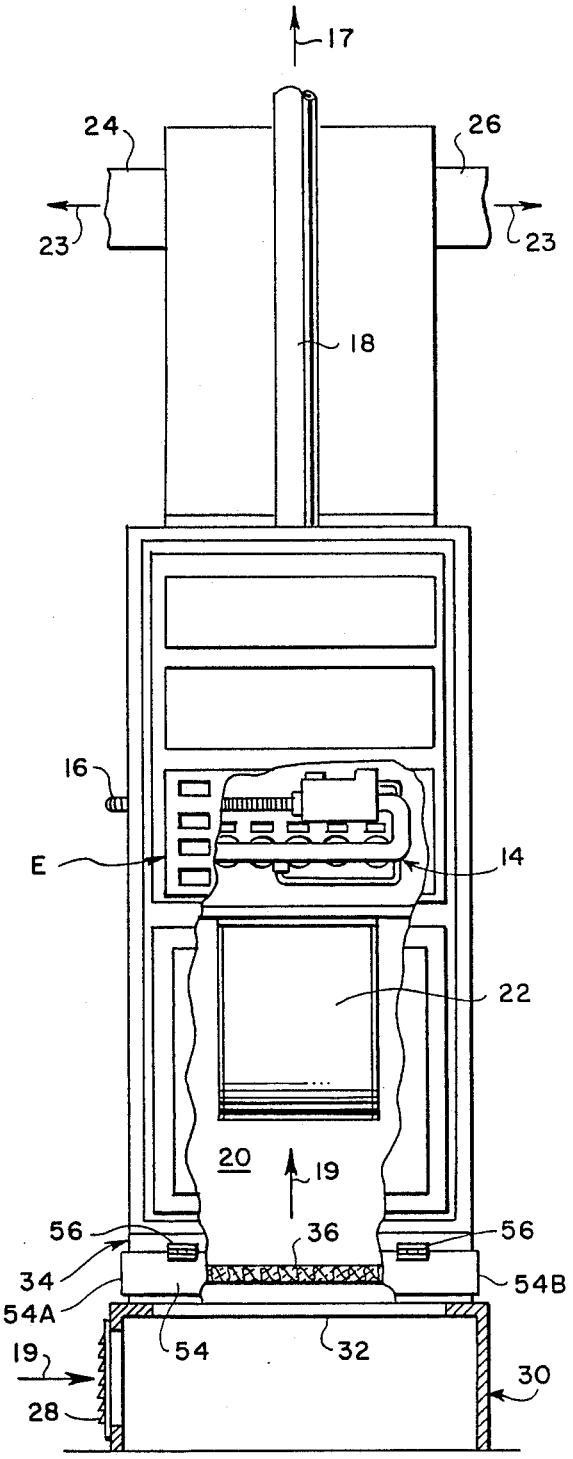
FIG. 2 is an enlarged front view of the furnace of FIG. 1 partially broken away and partially sectioned.

Referring now to the drawings, there is illustrated in FIG. 1 and FIG. 2 an upright flow forced air furnace 10 having a housing 12 containing gas burners 14 to which gas is supplied from an external source via pipe 16. The products of combustion 17 are discharged through a flue 18 while the majority of heat is transferred through heat exchanger E to recirculated air 19 in a plenum chamber 20. Within the plenum chamber, a motor operated blower 22 draws in return air 19 and causes the heated air 23 to be discharged overhead via ducts 24, 26 to the conditioned space (not shown).

Inlet air 19 to the furnace being returned from the conditioned space is provided through an inlet grille 28 provided in a rectangular externally open base 30. The return air chamber 30 has an upper flow passage opening 32 in flow communication with plenum chamber 20. Secured intervening between the furnace and return air chamber 30 is a filter base 34 which supports an air filter 36 for trapping dust particles from the passing airstream.

Filter 36 may be of the common variety widely available from commercial sources. Typically the filter will either be of the disposable throw-away type as might be formed of spun fiberglass or can comprise the more permanent reusable type of plastic or metal filament that can be periodically cleansed for removing dust accumulation.

Figure 3:
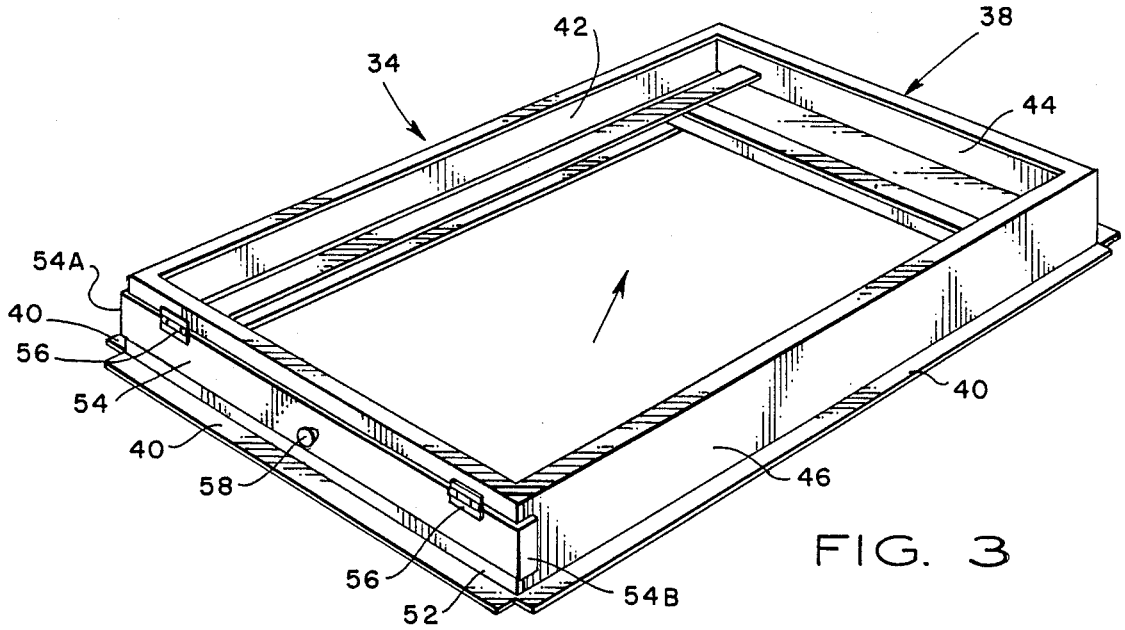
FIG. 3 is a perspective view f the filter housing as utilized in the furnace of FIG. 1 and FIG. 2; and, FIG. 4 is a view similar to FIG. 3 illustrating the placement and retrieval of an air filter within a filter housing support structure.
Figure 4:
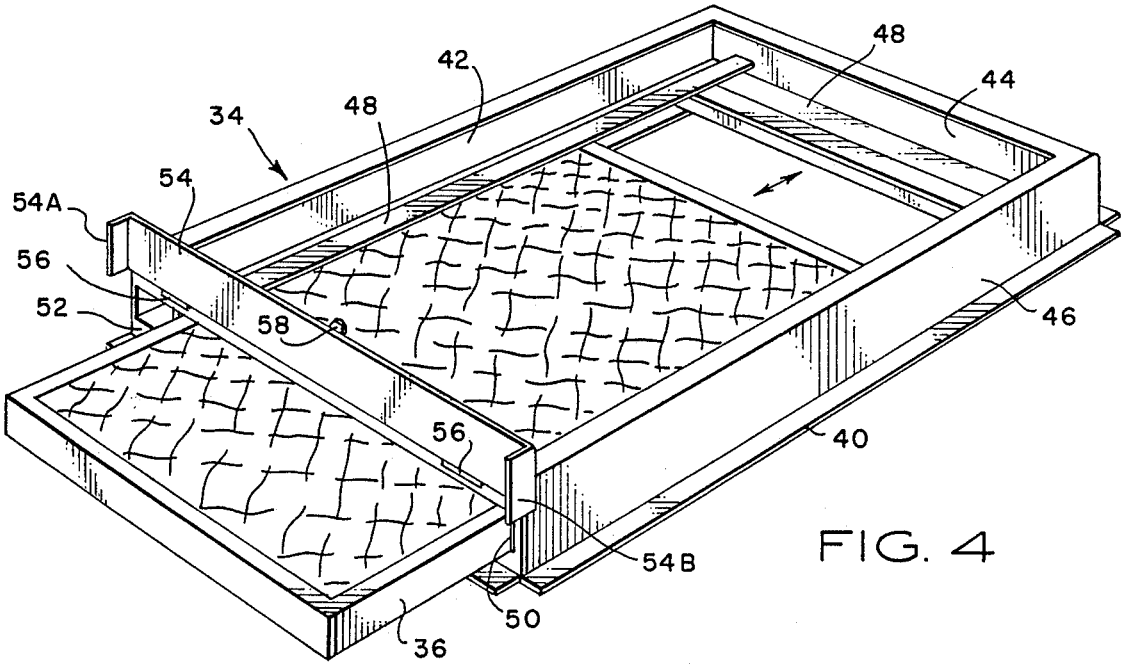

The filter base 34 hereof, as best seen in FIGS. 3 and 4, is comprised of a generally rectangular centrally open frame 38 defined by intersecting panel walls 42, 44, 46 and 52. Included along the exterior sides secured to the walls are a plurality of lateral flanges 40 extending about the periphery for mounting the frame between the furnace 10 and the supporting return air chamber 30. Extending about and secured to the interior of walls 42, 44 and 46 are intersecting channels 48 that extend in planar alignment with a filter access opening 50 defined in panel 52. The channels are selected with spacing between flanges in order to closely receive the sides and end of a rectangular filter 36 being placed through opening 50 and to support the filter between flanges when placement has been completed.

For providing access to opening 50 when filter replacement or removal is to be effected and to seal the opening 50 against leakage during normal operation of the furnace, there is provided an elongated rectangular sheet metal cover panel 54 that is secured via hinges 56 to the relatively upper portion of end panel 52. A thumbscrew 58 mounted at an intermediate location on access cover plate 54 permits the cover to be pulled and rotated about the hinges from the closed relation of FIG. 3 to the open access relation of FIG. 4. The thumbscrew 58 is engagable with a threaded weld nut mounted on the panel wall 52 whereby the cover 54 can be locked in the closed position if desired At such time as a filter 36 is properly in place within frame 38, the rear end of the filter adjacent opening 50 should be received inward of box 34 beyond the plane of access cover 54. In that manner, as cover 54 is restored from the open position of FIG. 4 to the closed position of FIG. 3, it will hang downwardly into a flush surface engagement against the surface of wall 52 about the opening 50. Side flanges 54A, 54B extend transverse to access panel 52 in parallel flush overlapping relation with sidewall panels 42, 46, respectively. By virtue of the flush relationship thereof, the cover panel 54 during operation of the furnace will be caused by the vacuum pressure of the returning air flow 19 flowing through blower 22 to be drawn tightly against wall 52 about opening 50 thereby preventing bypass leakage.

Moreover, by virtue of the close confinement of the filter within the flanges of channels 48, the filter 36 is secured against displacement or distortional offset. This factor assures that all air 19 entering through return air grille 28 will be induced to flow through filter 36 without bypassing the filter before entering plenum chamber 20. In view of the operational hinge relationship afforded cover 54, the cover is rendered self-sustaining in a vertical upright orientation in the open position of FIG. 4.

The dimensions of frame 38 are selected to match both the provided opening size in furnace housing 12 along with the filter size selected. Various filter sizes are considered standard in the trade and typically can comprise 14 inches by 25 inches by 1 inch; 16 inches by 25 inches by 1 inch; etc.

Referring again to FIG. 1 and FIG. 2, the filter housing assembly 34 is interposed between the return air base 30 and the furnace 12. The frame 38 is dimensioned appropriately so that the furnace unit 12 can rest directly onto the filter housing assembly 34 with its plenum chamber being directly centered over the filter 36.

By the above description, there is disclosed an improved filter support unit for an upflow forced air system providing greater ease of filter replacement than heretofore without the necessity of removing access panels or other similar type closures as has been customary in the prior art. Being that the filter sizes are somewhat standard in the trade, the size of the filter box 34 can similarly be standardized in corresponding sizes so as to fit various upflow forced air furnaces fabricated and sold by a variety of different manufacturers. The virtues thereof reside in the simplicity and convenience of filter removal such that assuming the furnace is otherwise placed in a convenient and accessible location, the ease of filter change-out afforded by the construction hereof will encourage maintenance personnel to perform the filter change-out or cleaning with recommended regularity.

Since many changes could be made in the above construction and many apparently widely different embodiments of this invention could be made without departing from the scope thereof, it is intended that all matter contained in the drawings and specification shall be interpreted as illustrative and not in a limiting sense.

What is claimed is:

1. In a forced air system for circulating conditioned air to and from a building space, said forced air system including an air conditioning unit housing containing a heat exchanger and an electrically operable blower fan disposed in said housing for inducing air flow across said heat exchanger, and a return air plenum disposed in air flow communication with said heat exchanger, said return air plenum having an inlet opening for receiving return air from said building space and having an outlet opening through which return air is discharged into said housing and across said heat exchanger, the improvement comprising:

a modular filter housing assembly providing mechanical foundation support for said housing and heat exchanger, said modular filter housing assembly being disposed intermediate said return air plenum and said conditioning unit housing, said filter housing assembly having wall portions defining the boundary of an air flow passage; filter support means attached to the inside surface of said filter housing for slideably receiving and supporting a removable filter element in said air flow passage; said filter housing having an access opening through which a filter element can be loaded onto and retrieved from said filter support means; and, a cover plate movably mounted on said filter housing above said access opening for pivotal movement from a first position overlapping the filter housing wall portion surrounding said access opening to effect sealed closure thereof, to a second position removed away from and uncovering said access opening to provide access to said filter support means, said cover plate being adapted to engage flush against the filter housing wall surface surrounding said access opening and to be drawn against said filter housing wall surface by a suction force developed by the flow of return air conducted through said return air plenum to effect sealed closure of said access opening during operation of said forced air system.

2. A modular filter base for supporting a forced air furnace on top of a return air plenum box comprising, in combination:

walls defining a rectangular enclosure having a central flow passage;

filter support means attached to the interior side wall surface of said enclosure for receiving and supporting a removable filter element across said flow passage;

one of said walls having an access opening aligned with said filter support means for accommodating placement and retrieval of a filter element onto and from said filter support means; and, a cover panel pivotally mounted on said rectangular enclosure in overhead relation to said access opening, said cover panel being disposed for pivotal movement between a first position in which said cover panel engages the wall panel surface surrounding said access opening to effect a sealed closure thereof to a second position rotated away from said wall panel surface to expose said access opening, said cover panel being adapted to be drawn into sealing engagement against said wall panel surface by a suction force developed by the flow of return air flowing through said central flow passage.

3. A method for operating a force air system for circulating conditioned air to and form a building space in which an air conditioning unit housing containing a heat exchanger and an electrically operable blower fan are coupled in air flow relation to a return air plenum comprising the steps:

interposing a modular filter assembly between said conditioning unit housing and said return air plenum, with said modular filter assembly providing mechanical support for said conditioning unit housing and providing an air flow passage communicating with said return air plenum and said heat exchanger;

providing support for a filter element at a location across said air flow passage within said modular filter housing;

providing an access opening in said modular filter assembly which is aligned with said filter support location;

covering said access opening with a cover plate which is coupled by a hinge to said modular filter housing in overhead relation to said access opening so that said cover plate hangs downwardly in covering relation to said access opening in response to the force of gravity; and, drawing said cover plates into sealing engagement against said modular filter housing in response to the suction force developed by the flow of air through said air passage.

* * * * *

UNITED STATES PATENT AND TRADEMARK OFFICE

CERTIFICATE OF CORRECTION

PATENT NO. : 4,827,901

DATED : 05/09/89

INVENTOR(S) : Jerry D. Jackson and Terry D. Youngblood

It is certified that error appears in the above-identified patent and that said Letters Patent is hereby corrected as shown below:

Column 2, line 34, "support filter" should be -- support a filter --.

Column 2, line 55, "view f" should be -- view of --.

Column 6, line 10, "form" should be -- from --.

Column 6, line 34, "plates" should be -- plate --.

Signed and Sealed this

Tenth Day of October, 1989

*Attest:*

*Attesting Officer*

DONALD J. QUIGG

*Commissioner of Patents and Trademarks*